US005348165A

United States Patent [19]

Pomerleau

[11] Patent Number: 5,348,165

[45] Date of Patent: Sep. 20, 1994

[54] SELF-STANDING UPRIGHT COAT HANGER

[76] Inventor: Jocelyn Pomerleau, 4860 Blvd des Cimes, Montchatel, Québec, Canada, G2A 4C1

[21] Appl. No.: 24,214

[22] Filed: Mar. 1, 1993

[51] Int. Cl.[5] ..... A47F 7/00

[52] U.S. Cl. ..... 211/13; 211/34

[58] Field of Search ..... 211/13, 34, 37, 208; 248/161, 407, 408, 409; 223/85, 88, 92, 94; 297/90

[56] References Cited

U.S. PATENT DOCUMENTS

| | | | |
|---|---|---|---|
| 381,437 | 4/1888 | Smith | 211/208 X |
| 1,360,912 | 11/1920 | Folmar | 297/190 X |
| 2,262,581 | 11/1941 | Gonczy | 297/190 |
| 3,100,128 | 8/1963 | Gleitsman et al. | 211/34 X |
| 3,126,237 | 3/1964 | Kirk | 297/190 X |
| 3,747,774 | 7/1973 | Kulik | 211/37 |
| 4,706,915 | 11/1987 | Cindric et al. | 248/161 X |
| 5,025,935 | 6/1991 | Hadachek | 211/13 X |

*Primary Examiner*—Robert W. Gibson, Jr.
*Attorney, Agent, or Firm*—Pierre Lespérance; Francois Martineau

[57] ABSTRACT

A self-standing hanger for supporting the water-dripping gear of firefighters and the like. The hanger can further be used in alternative fashion as a boundary mark post, e.g. in its extended condition, for establishing a security control area in firefighting conditions. The hanger may further be retracted, when not in use, or even when supporting a dried up firefighter's outfit in a storage room, so as to take the least volume for storage. Rot of the suit is therefore prevented. The self-standing hanger may support any other type of coat.

5 Claims, 4 Drawing Sheets

SELF-STANDING UPRIGHT COAT HANGER

FIELD OF THE INVENTION

This invention relates to coat hangers of the self-standing type.

BACKGROUND OF THE INVENTION

The inventor is not aware of any relevant prior art.

OBJECTS OF THE INVENTION

The gist of the invention is to provide a self-standing, telescopic coat hanger for firefighters or other persons, which can be alternately used as a member constituting a boundary mark for establishing a security control area in firefighting conditions, yet which may be stored in a small area when not in use.

An important object of the invention is to address the problem of existing, rot-inducing, storage conditions for firefighter's water-dripping garments, after use.

SUMMARY OF THE INVENTION

According to the object of the invention, there disclosed a self-standing coat hanger device, for use in supporting the suit of firefighters and the like both before and after use during fire containing and extinguishing operations, and alternately for use in constituting a boundary mark for establishing a security control area in firefighting conditions, said coat hanger device consisting of: (a) a ground-engageable base; (b) a post, integrally mounted at its bottom end to said base in upright condition, and defining a triangular support member at its top free end, said triangular support member for supporting a firefighter's coat; (c) means for telescopingly extending said post and for locking same at selected telescoped increments.

Preferably, there is further included bridle means, for releasably securing firefighter's boots to said ground base. Advantageously, there is further including means for telescopingly extending said ground base for fitting firefighter's boots of varied sizes. It is envisioned that said base telescoping means consist of a fixed bedplate member, for supporting and releasably securing the heel portion of a pair of boots, and a pair of slidable bedplate members, located on opposite sides of said fixed bedplate, biasing means being provided to bias each said slidable bedplate members toward said fixed bedplate member, said bridle means being mounted to said slidable bedplate members.

Profitably, said post telescoping means consists of a lower, fixed post part and an upper, extensible post part, a latch member releasably interlocking said lower and upper post parts at a selected one of a plurality of partially extended conditions, and biasing means to bias said latch member in a locking mode where said lower and upper post parts are interlocked.

Preferably, said post, including said triangular top end, defines an exterior, light-reflecting surface.

DETAILED DESCRIPTION OF THE INVENTION

Figure 1:
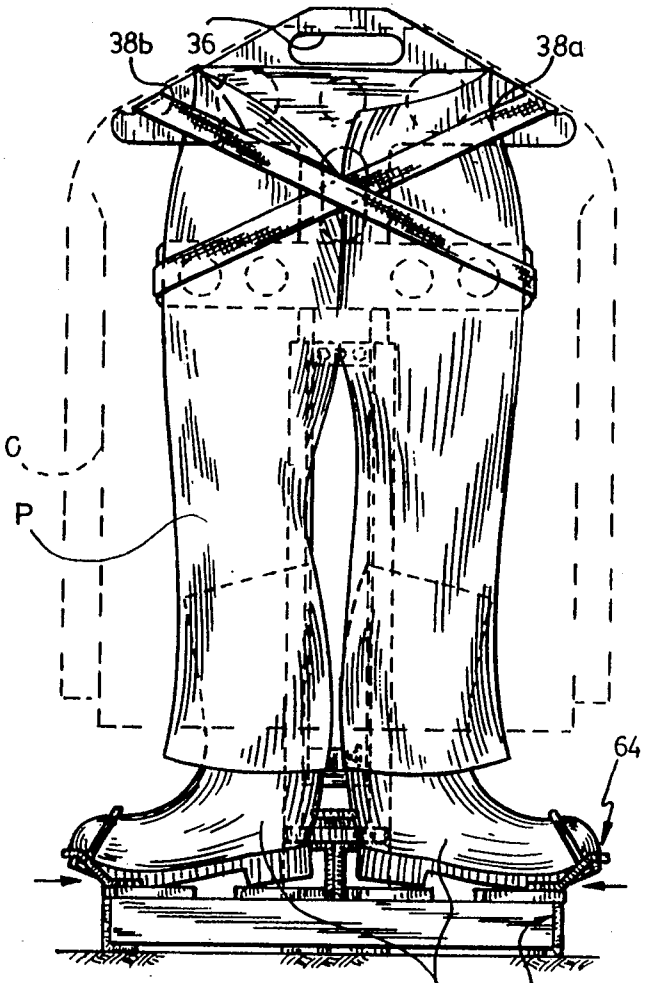
FIGS. 1 and 2 are front elevations of a preferred embodiment of self-standing coat hanger according to the invention, FIG. 1 further showing a firefighter's waterproof pants and boots, in full lines, and coat, in phantom lines.

The present suit hanger is a self-standing coat hanger, for dual use in supporting the suit of a firefighter both before and after use, during fire containing and extinguishing operations, as well as for alternately constituting a boundary mark for a security control area in firefighting conditions, when the firefighter's gear is removed therefrom.

The self-standing suit hanger 20 is of generally H-shape (the H being laid on its side), defining a main, upright post member 22, a ground-engageable horizontal base 24, transversely mounted to the bottom end of post member 22, a triangular coat shoulder support plate 28 being transversely mounted to the top end of post member 22, and a rectangular, pant waist support bar 30 being transversely mounted to the intermediate section of upright post member 22.

Upright post member 22 is telescopic, defining a lower, fixed, post segment, 22*a*, being fixedly anchored to ground base 24, and an upper post segment, 22*b*, integral to members 28 and 30 and slidable axially of lower post segment 22*a*. Therefore, the height of shoulder support 28 relative to ground can be adjusted. A releasable latch member 26 (FIGS. 9 and 9*a*) locks telescopic elements 22*a*, 22*b*, to one another at a selected one of a plurality of partially extended positions of the telescopic member 22.

The top apex of triangular plate 28 is preferably pierced by a large, hand-engageable, ovoidal slot 36, for facilitating hand-grasping of the triangular plate 28 in view of retracting or extending telescoping member 22*b*, 28. Profitably, plates 28, 30 and telescoping member 22*b* each includes a number of through-bores, 36*a*, 36*b*, 36*c*, in view of reducing the total weight of the coat hanger device 20.

To secure the pants P to the garment support device 20, there is envisioned to provide a pair of flexible straps 38*a*, 38*b*, one at each of the two opposite ends of elongated, horizontal bar 30. As suggested in FIG. 1, straps 38*a*, 38*b*, are made to cross-tie around the waist portion of the pants, and to further frictionally releasably engage into a pair of corresponding notches 40*a*, 40*b*, made on the two downwardly-outwardly inclined upper edges of triangular plate 28, whereby an X-shape strap outline is obtained.

Most preferably, at least one of the upper telescopic member 22*b*, the triangular plate 28, the rectangular pant support bar 30, or the lower telescopic member 22*a*, defines an outer surface having high light collecting and light-reflecting properties. Such light reflecting coating may be for example of the type used at the top end of road sign markers, to indicate road curbs or the like to motorists during night-time driving. Hence, a number of self-support members 20 may then be used as visually striking boundary markers, when garment is removed from the hanger 28 and pant support 30, for setting a security control area during the work of firefighters in action.

Figure 2:
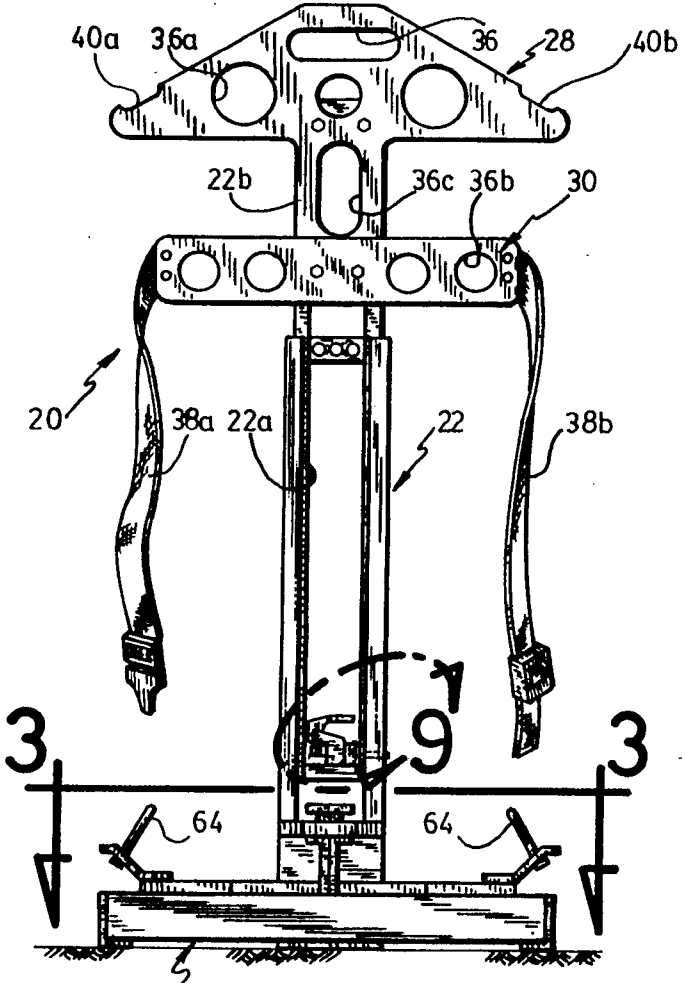
Figure 11:
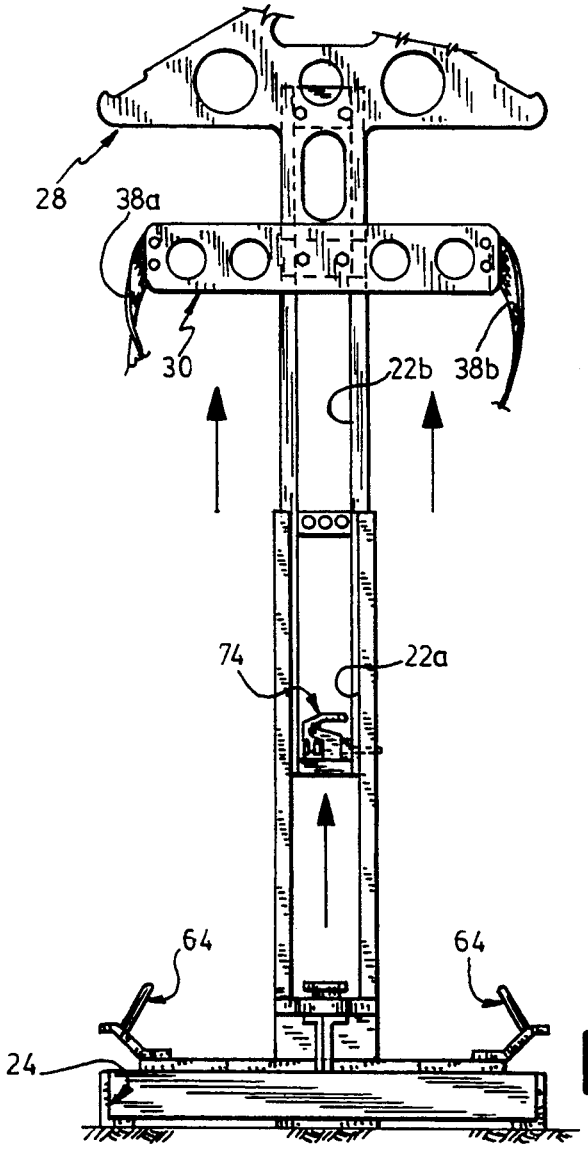
FIG. 11 is a view similar to FIG. 2, but with the telescopic post in extended condition.
Figure 12:
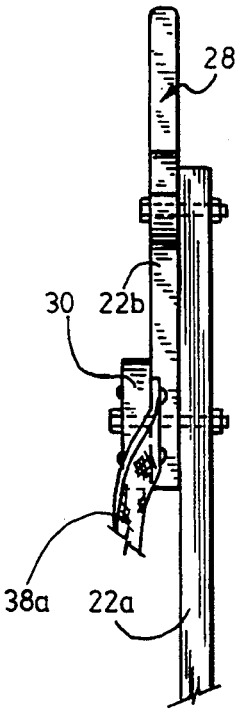
FIG. 12 is a lateral side elevation of the upper elements of FIG. 11.

As suggested in FIG. 1, plate 28 supports in the conventional fashion the shoulder portion of a firefighter coat C, while plate 30 supports the waist of the firefighter pants P (FIG. 1), so that the whole firefighter garment can be suspended over ground to the suit hanger 20. It is understood that, when the firefighter garment is all soaked up with fire hydrant hose spray water, upper telescopic bar 22*b* is to be extended (FIG. 11), while when the garment has become dried with time, telescopic bar 22*b* is downwardly retracted (FIG. 2), to enable reduced storage area for the suit.

Figure 6:
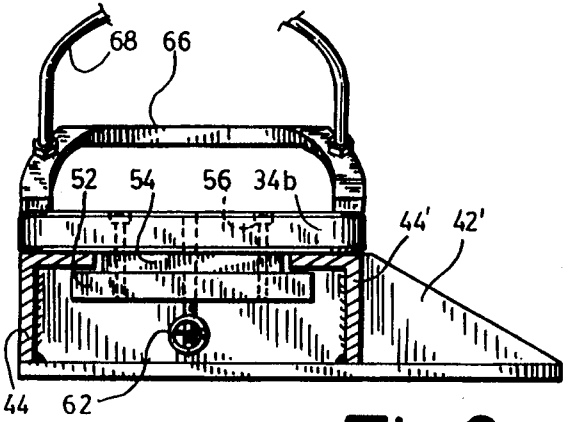

The advantage of the present self-standing suit hanger 20 is to promote good ventilation of the soaked up garment, CP, since all of the garment CP hangs over ground, compared to conventional rot-inducing, high-humidity method of simply stacking the suits one over the others in closed drawers. Yet, very small space is required for storage thereof. Furthermore, the suit CP on the hanger device 20 is easily donned from and undonned onto same. Garment crease likeliness is further reduced (FIG. 6).

It is envisioned to provide a suit protective bag, not shown, including a number of inner pockets, for receiving gloves, alternate garments, glasses, and the like. This protective bag would surroundingly envelop the garment CP when the latter is supported over ground by the support 20.

The hanger device 20 may further be retracted, when not in use, or even when supporting a dried up firefighter's outfit in a storage room, so as to take the least volume for storage. Rot of the suit is therefore prevented, since air circulates therearound. Of course, the self-standing hanger 20 may support any other type of coat, and is not limited to firefighters' gear.

Advantageously, those parts of the hanger device 20 coming in direct contact with the firefighter's gear—namely the top, coat supporting, triangular plate 28, the intermediate, pant supporting, rectangular plate 30, and the bottom, two pairs of boot support panels 32*a*, 32*b*, 34*a*, 34*b*—are made from a plastic material, preferably TEFLON (a registered trademark); while the remaining structural elements (base 24, lower post member 22*a*) will be made from a rigid lightweight material, preferably an aluminum alloy or stainless steel, with the external light-reflecting coating as hereinabove described. In any event, all the selected materials must be waterproof.

FIGS. 3–6 show in detail the base 24 of the coat support device 20. Base 24 includes an elongated pair of laterally opposite, ground-engaging, stabilizing skates 42, 42' of generally L-shape in cross-section, and a pair of link bars 44, 44', also of L-shape cross-section, integrally spacedly interconnecting skates 42 and 42'. Link bars 44, 44' which are supported by ground engaging skates 42 and 42', spacedly over ground, define two top, inturned, horizontal legs 44*a*, 44'*a*, whereby an elongated channel 46 is defined between legs 44*a* and 44'*a*.

Figure 8:
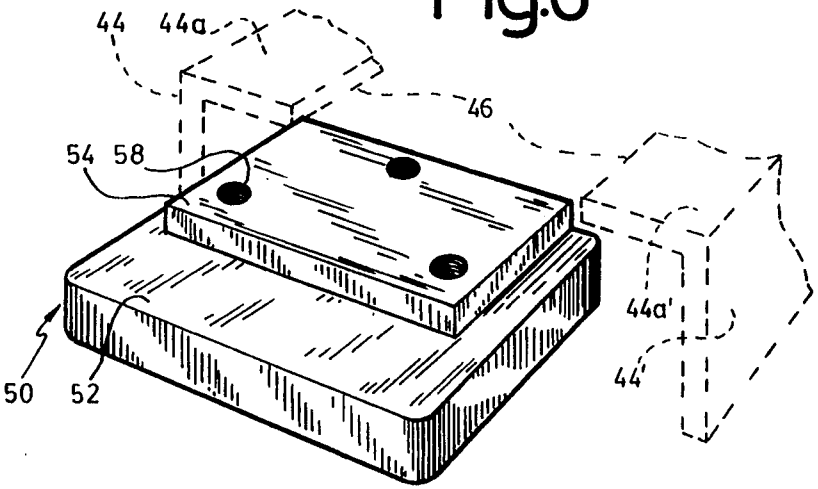
FIG. 8 is an isometric, exploded, fragmentary view of self-standing hanger base, with the ground-engaging frame thereof being illustrated in phantom lines.

Intermediate fixed bedplates 32*a*, 32*b*, are fixedly anchored to legs 44*a* and 44'*a* of link bars 44, 44', by bolts 48, while movable end bedplates 34*a*, 34*b*, are free to slide thereover. Bedplates 34*a*, 34*b*, are slidably mounted to the rails 44, 44', by corresponding slider blocks 50, 50' (FIG. 8), which prevent bedplates 34*a*, 34*b* from escaping the channel 46. Each block 50, 50', consists of two superimposed, integrally connected, quadrangular, flat plates 52 and 54. Plate 52 is wider than channel 46, while plate 54 is slightly less wide than the width of channel 46. Bedplates 34*a*, 34*b*, are anchored to slider block plates 54 by bolts 56 (FIG. 6) engaging through threaded cavities 58 of plate 54. Each slider block 50, 50' includes a downwardly-projecting intermediate finger 60, 60' respectively. An elongated coil spring 62 springingly interconnects the two fingers 60, 60', and extends freely through the hollow of base 24, beneath the fixed bedplates 32*a*, 32*b*, whereby slidable bed plates 34*a*, 34*b* are continuously biased one toward the other i.e. toward the fixed bedplates 32*a*, 32*b*.

A bridle 64 (FIGS. 3–4 and 6) is fixedly connected to each slidable bedplate 34*a*, 34*b*, projecting upwardly and laterally outwardly therefrom. Each bridle 64 includes a first, upwardly laterally outwardly, elbowed, metallic U-frame 66, and a second, metallic U-frame 68 integral to the laterally outward end of U-frame 66 and projecting upwardly laterally inwardly thereof. Bridle 64 forms an open pocket, for receiving and releasably securing the toe end of a firefighter's boot B.

The adjacent end portions of fixed bedplates 32*a*, 32*b* further include an upright, integral, cross-sectionally T-shape, metallic bracket 70, for engagement by the corresponding heel ends of the two boots B, B. A further elastomeric, cross-sectionally H-shape, abutment member 72 may be integrally mounted over bracket 70, for forming two subpockets for holding more firmly the boot heel end.

It is understood that, as a boot B is installed over bed plates 32*a*, 34*a*, or 32*b*, 34*b*, bridle 64 is moved laterally outwardly against the bias of coil spring 62, to allow boot toe end engagement therein, then bridle 64 is released whereby the boot heel end is forcibly biased against seat 70, 72, under the bias of spring 62. Hence, the boot B is releasably locked to the top surface of base 24, under the bias of the extension spring 62. Bridle 64 is preferably made from stainless steel.

Figures 3, 4, 5:
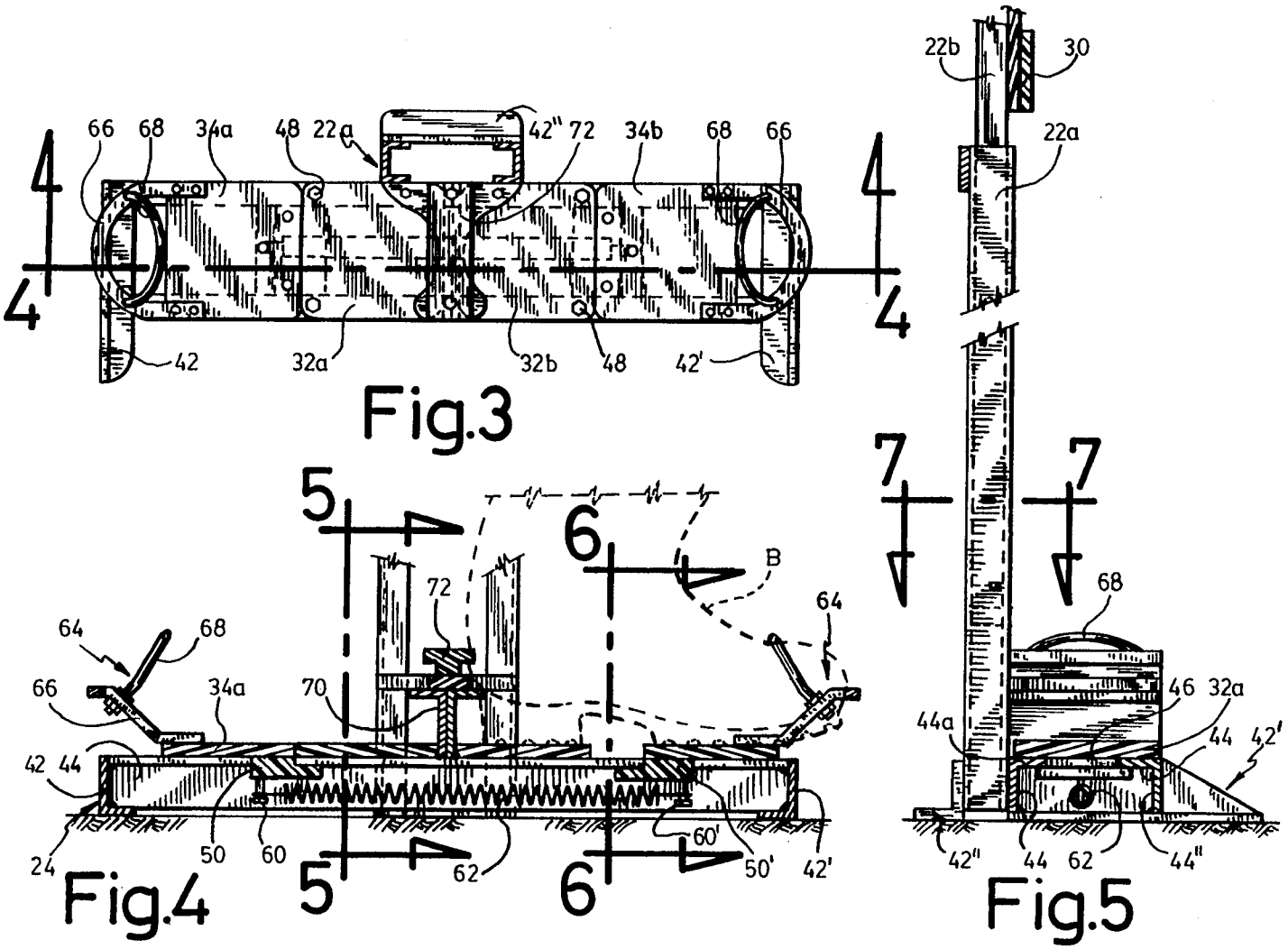
FIG. 3 is an enlarged top plan view of the self-standing hanger base, taken from perspective 3—3 of FIG. 2.
FIG. 4 is a sectional view of the self-standing hanger base, taken along line 4—4 of FIG. 3.
FIGS. 5 and 6 are cross-sectional views of the self-standing hanger base, taken along lines 5—5 and 6—6 respectively of FIG. 4, FIG. 6 being at an enlarged scale.
Figure 7:
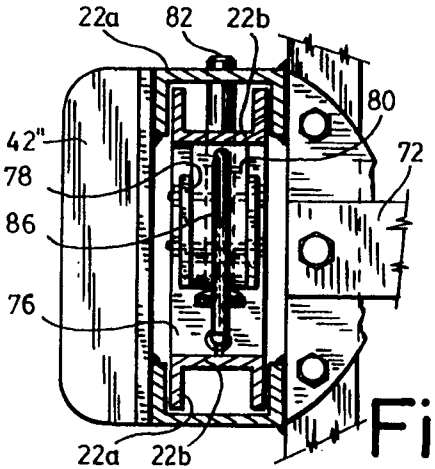
FIG. 7 is an enlarged cross-section of the self-standing hanger post, taken along line 7—7 of FIG. 5.

As illustrated in FIG. 3, upright post element 22*a* is hollow, generally rectangular in cross-section, and is supported at its bottom end spacedly over ground by a skate member 42''.

The latch means 74 that locks telescopic post member 22*a*, 22*b*, at a selected extended position of extensible part 22*b* relative to fixed (lower) post part 22*a*, is illustrated in FIGS. 7, 9–9*a* and 10. Latch means 74 includes a support plate 76, extending transversely of and integral to extensible part 22*b*. A yoke member 78 is anchored to plate 76 thereabove, and defines a horizontal through-channel 80 being slidingly engaged by a lock rod 82. Yoke member 78 defines an elbowed upper free end, being provided with a pivot axle 84, extending transversely of elongated post 22*b* and carrying a pivotal, elongated, control lever 86, at an intermediate section thereof. Lever 86 includes an integral Y-shape ear 86*a* (FIG. 10), freely engaging transversely around lock rod 82, about a threaded end portion thereof, 82*a*.

Figure 9:
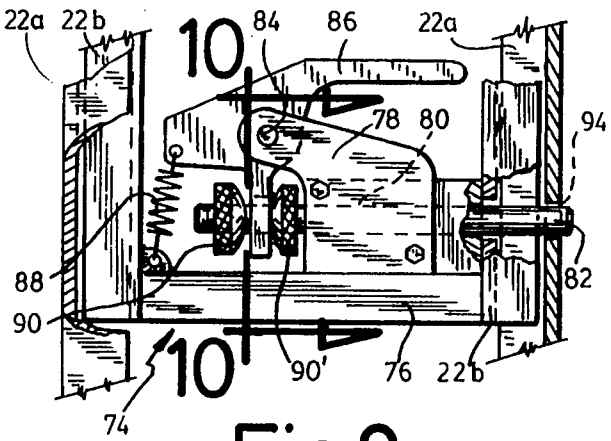
FIGS. 9 and 9*a* are enlarged, partly cut-away views of the area circumscribed by ellipse 9 in FIG. 2, suggesting how the upright post of the self-standing hanger can be telescopingly extended by releasing the locking latch thereof.
Figure 9A:
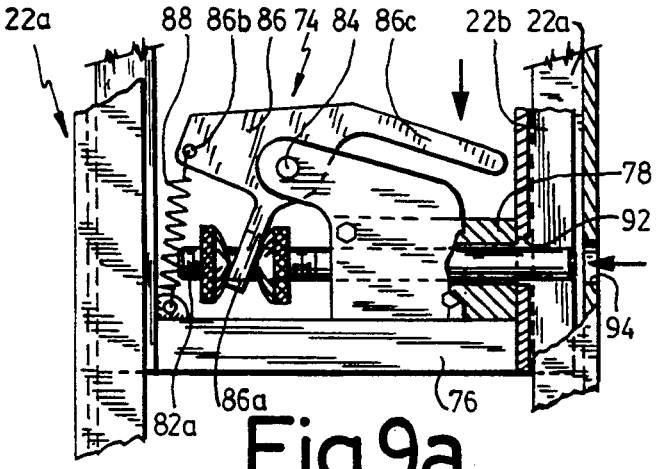
Figure 10:
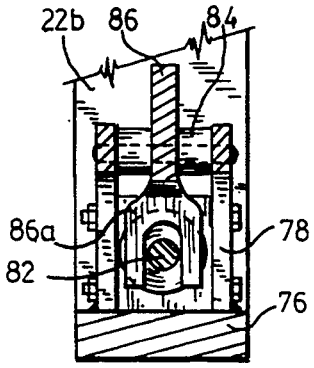
FIG. 10 is a cross-section taken along lines 10—10 of FIG. 9.

Toggle lever 86 defines two opposite ends 86*b*, 86*c*, with pivot 84 being located intermediate thereof. A coil spring 88 interconnects toggle end 86*a* to a registering end of support plate 76, whereby the latter are biased toward one another. A pair of nuts 90, 90', threadingly engage rod plate 82*a*, on opposite sides respectively of Y-ear 86*a*, wherein coil spring 88 biases rod 82 to extend beyond yoke member 78 freely through selected apertures 92, 94, in post sections 22*b*, 22*a*, respectively, and slightly therebeyond (FIG. 9). Upon downwardly depressing toggle end 86*c*, Y-ear 86*a* moves away from yoke 78, against the bias of spring 88 (FIG. 9*a*), wherein lock rod 82 retracts from transverse bore 94 of outer (fixed) hollow post part 22*a* so that post part 22*b* be allowed to move freely axially of post part 22*a*.

Preferably, fixed post 22*a* includes a number of lengthwisely-spaced, transverse bores 94, into any selected one of which rod 82 is releasably engageable, at a selected extended position of extensible post 22*b*. Yet, the bias of spring 88 automatically brings latch 74 to its locked position (FIG. 9) when rod 82 extends through and beyond bore 94.

It is understood that, whenever we mention a "firefighter" coat, boot, garment or gear, other types of such garment are also envisioned, and thus, the word "firefighter" is only illustrative of one appropriate exemplary type of garment, but is not limitative thereof.

I claim:

1. A self-standing coat hanger device, for use in supporting the suit of a firefighter and the like both before and after use during fire containing and extinguishing operations, and alternately for use in constituting a boundary mark for establishing a security control area in firefighting conditions, said coat hanger device consisting of:

(a) a ground-engageable base;

(b) a post, integrally mounted at its bottom end to said base in upright condition, and defining a triangular support member at its top free end, said triangular support member for supporting a firefighter's coat;

(c) means for telescopingly extending said post and for locking same at selected telescoped increments (d) bridle means, for releasably securing firefighter's boots to said ground base.

2. A self-standing coat hanger device as defined in claim 1, further including means for telescopingly extending said ground base, for fitting firefighter's boots of varied sizes.

3. A self-standing coat hanger device as defined in claim 1, wherein said post telescoping means consists of a lower, fixed post part, and an upper, extensible post part, a latch member releasably interlocking said lower and upper post parts at a selected one of a plurality of partially extended conditions, and biasing means to bias said latch member in a locking mode where said lower and upper post parts are interlocked.

4. A self-standing coat hanger device as defined in claim 2, wherein said base telescoping means consists of a fixed bedplate member, for supporting and releasably securing the heel portion of a pair of boots, and a pair of slidable bedplate members, located on opposite sides of said fixed bedplate, biasing means being provided to bias each said slidable bedplate members toward said fixed bedplate member, said bridle means being mounted to said slidable bedplate members.

5. A self-standing coat hanger device as defined in claim 1, wherein said post, including said triangular top end, defines an exterior, light-reflecting surface.

* * * * *